US010240111B2

(12) United States Patent
Bautista Cid et al.

(10) Patent No.: US 10,240,111 B2
(45) Date of Patent: Mar. 26, 2019

(54) LAUNDRY ADDITIVE

(71) Applicant: Colgate-Palmolive Company, New York, NY (US)

(72) Inventors: Oscar Bautista Cid, Mexico City (MX); Jose Javier Tovar Pescador, Mexico City (MX)

(73) Assignee: Colgate-Palmolive Company, New York, NY (US)

( * ) Notice: Subject to any disclaimer, the term of this patent is extended or adjusted under 35 U.S.C. 154(b) by 4 days.

(21) Appl. No.: 15/527,505

(22) PCT Filed: Nov. 21, 2014

(86) PCT No.: PCT/US2014/066768
§ 371 (c)(1),
(2) Date: May 17, 2017

(87) PCT Pub. No.: WO2016/081006
PCT Pub. Date: May 26, 2016

(65) Prior Publication Data

US 2017/0321166 A1 Nov. 9, 2017

(51) Int. Cl.

| | |
|---|---|
| ***C11D 1/72*** | (2006.01) |
| ***C11D 1/722*** | (2006.01) |
| ***C11D 1/74*** | (2006.01) |
| ***C11D 3/12*** | (2006.01) |
| ***C11D 3/37*** | (2006.01) |
| ***C11D 3/40*** | (2006.01) |
| ***C11D 3/50*** | (2006.01) |
| ***B08B 3/04*** | (2006.01) |
| ***C11D 1/825*** | (2006.01) |
| ***C11D 3/00*** | (2006.01) |
| ***C11D 3/20*** | (2006.01) |
| ***C11D 3/22*** | (2006.01) |

(52) U.S. Cl.
CPC ..... *C11D 3/50* (2013.01); *C11D 1/72* (2013.01); *C11D 1/74* (2013.01); *C11D 1/825* (2013.01); *C11D 3/001* (2013.01); *C11D 3/0068* (2013.01); *C11D 3/1213* (2013.01); *C11D 3/1253* (2013.01); *C11D 3/2065* (2013.01); *C11D 3/2093* (2013.01); *C11D 3/221* (2013.01); *C11D 3/3707* (2013.01); *C11D 3/40* (2013.01); *C11D 3/505* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,264,466 | A | 4/1981 | Carleton et al. | |
| 4,365,853 | A | 12/1982 | Ehrlich | |
| 7,056,877 | B2 | 6/2006 | Caswell et al. | |
| 7,091,171 | B2 | 8/2006 | Caswell et al. | |
| 7,166,565 | B2 | 1/2007 | Caswell et al. | |
| 7,186,680 | B2 | 3/2007 | Caswell et al. | |
| 7,494,965 | B2 | 2/2009 | Caswell et al. | |
| 7,544,651 | B2 | 6/2009 | Caswell et al. | |
| 7,786,027 | B2 | 8/2010 | Aouad et al. | |
| 7,867,968 | B1 | 1/2011 | Aouad et al. | |
| 7,871,976 | B1 | 1/2011 | Aouad | |
| 8,476,219 | B2 | 7/2013 | Aouad | |
| 8,497,234 | B2 | 7/2013 | Mayer et al. | |
| 8,586,279 | B2 | 11/2013 | Williams et al. | |
| 2003/0104969 | A1 | 6/2003 | Caswell et al. | |
| 2007/0269651 | A1 | 11/2007 | Denome et al. | |
| 2008/0014393 | A1 | 1/2008 | Denome et al. | |
| 2009/0042766 | A1 | 2/2009 | Mayer et al. | |
| 2013/0095717 | A1 | 4/2013 | VanBlarcom et al. | |
| 2013/0267454 | A1 | 10/2013 | Aouad | |
| 2014/0057825 | A1 | 2/2014 | Denome et al. | |
| 2014/0179587 | A1* | 6/2014 | Brown | C11D 3/3707 510/349 |

FOREIGN PATENT DOCUMENTS

| | | | |
|---|---|---|---|
| CA | 2405845 | 11/2001 | |
| CA | 2682636 | 1/2010 | |
| EP | 2021172 | 5/2010 | |
| EP | 2049587 | 3/2013 | |
| MX | 2008/014212 | 11/2008 | |
| MX | 2008/014213 | 11/2008 | |
| MX | 2012/005260 | 6/2012 | |
| WO | WO 2007/111888 | 10/2007 | |
| WO | WO 2008/009521 | 1/2008 | |
| WO | WO 2008/135333 | 11/2008 | |
| WO | WO 2013/036662 | * 3/2013 | C11D 3/40 |

OTHER PUBLICATIONS

Provista. 2012, Evafix® 860 Material Safety Data Sheet.
International Search Report and Written Opinion in International Application No. PCT/US2014/066768, dated Jul. 28, 2015.

* cited by examiner

*Primary Examiner* — Brian P Mruk

(57) ABSTRACT

A laundry additive composition comprising a) at least one oxylated material chosen from polyoxyalkylene, a polyoxyalkylene fatty acid ester, and a polyoxyalkylene fatty alcohol ether; b) a polyol; c) a coloring agent; and d) at least one additive chosen from fragrance and a fabric treatment material. The composition can deliver the additive to clothing during washing or rinsing of the clothes, such as to impart a fragrance to clothing.

19 Claims, No Drawings

LAUNDRY ADDITIVE

BACKGROUND

Fragrances are commonly added to many laundry products to impart scent to clothes. Scent additives, or scent boosters, are products that contain fragrance-containing solids, usually along with detergent. The fragrance-containing solids provide enhanced fragrance perception at the end of washing, as well as in the dried garment, when tumble-dried at elevated temperatures. One consideration in the design of scent boosters for use in wash or rinse cycles is that the fragrance is effectively imparted to the garments, and is not washed away.

Other additives for laundry products include antibacterial compounds, which prevent or inhibit growth of bacteria, and fabric conditioners and/or antistatic agents, winch impart softness and anti-static benefits to the composition. Formulating these compounds in a way which preserves their increases their functional characteristics is a continuing challenge.

While the prior art discloses the use of various compositions for delivering fragrance, antibacterials, fabric conditioner and other laundry additives, there is still a need for additional compositions and methods which provide improved performance in such treatments.

BRIEF SUMMARY

Provided is a laundry additive composition comprising a) at least one oxylated material chosen from polyoxyalkylene, a polyoxyalkylene fatty acid ester, and a polyoxyalkylene fatty alcohol ether; b) a polyol; c) a coloring agent; and d) at least one additive chosen from fragrance and a fabric treatment material.

Also provided is a method of delivering an additive to clothes comprising washing the clothes in the presence of the composition. The composition can be added in the first stage or wash cycle of a clothes washing machine or during the second stage or rinse cycle of the clothes washing machine.

Also provided is a use of the composition that includes fragrance for washing clothes to impart a fragrance to the clothes.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DESCRIPTION

The following description of the preferred embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

According to one embodiment, the laundry scent additive (i.e., scent booster) composition is formulated as a stand-alone product, which can be added to the washing or rinsing cycle of a clothes washing machine, or to a tub or other container used for manually washing clothes. The formulation can be in any of a variety of solid and liquid forms, for example a powder, pellet, tablet, pastille or extrudate. Such scent booster compositions enables consumers to control the amount of scent imparted to their laundry, and can also provide extra benefits, from additional actives optionally present in the composition.

The invention therefore provides, in a first embodiment, a laundry scent additive composition (Composition 1) comprising a) at least one oxylated material chosen from polyoxyalkylene, a polyoxyalkylene fatty acid ester, and a polyoxyalkylene fatty alcohol ether; b) a polyol; c) a coloring agent; and d) at least one additive chosen from fragrance and a fabric treatment material; for example:

1.1 Any foregoing composition, wherein the oxylated material is present in the composition in an amount of 30-90% by weight of the composition.

1.2 Any foregoing composition, wherein the polyoxyalkylene comprises:

a polyethylene glycol;

a polyalkylene polymer of formula: $H—(C_2H_4O)_x—(CH(CH_3)CH_2O)_y—(C_2H_4O)_z—OH$;

wherein x is from 50 to 300; y is from 20 to 100, and z is from 10 to 200;

a polyethylene glycol fatty acid ester of formula: $(C_2H_4O)_q—C(O)O—(CH_2)_r—CH_3$; wherein q is from 20 to 200, and r is from 10 to 30; and a polyethylene glycol fatty alcohol ether of formula: $HO—(C_2H_4O)_s—(CH_2)_t—CH_3$; wherein s is from 30 to 250, and t is from 10 to 30.

1.3 The composition of 1.2, wherein the polyethylene glycol is present in the composition in an amount of 30 to 90% by weight of the composition.

1.4 The composition of claim 1.2 or 1.3, wherein the polyalkylene polymer is present in the composition in an amount of 15 to 40% by weight of the composition.

1.5 The composition of any of claims 1.2 to 1.4, wherein the polyethylene glycol fatty acid ester is present in the composition in an amount of 1 to 10% by weight of the composition.

1.6 The composition of any of claims 1.2 to 1.5, wherein the polyethylene glycol fatty alcohol ether is present in the composition in an amount of 1 to 10% by weight of the composition 1.7 The composition of any of claims 1.2 to 1.6, wherein the polyethylene glycol has a weight average molecular weight of 2,000 to 10,000.

1.8 The composition of claim 1.7, wherein the polyethylene glycol has a weight average molecular weight of 2,500 to 4,000.

1.9 Any foregoing composition, wherein the polyol is selected from the group consisting of glycerin and sorbitol, optionally the polyol is glycerin.

1.10 Any foregoing composition, herein the polyol is present in an amount of 0.1 to 10% by weight of the composition.

1.11 Any foregoing composition, wherein the fragrance is present in the composition in an amount of from 0.1 to 30% by weight of the composition.

1.12 Any foregoing composition, wherein the additive is fragrance and is present as a free fragrance.

1.13 The composition of 1.12, wherein the free fragrance is present in an amount of 0.1 to 10% by weight of the composition.

1.14 Any foregoing composition, wherein the additive is fragrance and is an encapsulated fragrance.

1.15 The composition of 1.14, wherein the encapsulated fragrance is present in an amount of 0.1 to 10% by weight of the composition.

1.16 The composition of any of 1 to 1.12, wherein the additive comprises:

free fragrance in an amount of 0.1 to 10% by weight of the composition, and encapsulated fragrance in an amount of 0.1 to 10% by weight of the composition.

1.17 Any foregoing composition, wherein the additive is the fabric treatment material and is selected from the group consisting of a fabric conditioning agent, anti static agent, an alkyl trimethyl ammonium compound, an amidopropyl trimethyl ammonium compound, a fatty acid amide, tetraethylenepentamine, amine functional silane for example 5-(3-(trihydroxysilyl)propyldimethyloctalecyl ammonium chloride), and cetyl trimethylammonium chloride and combinations thereof.

1.18 Any foregoing composition, wherein the coloring agent is present in an amount of 0.001 to 5% by weight of the composition.

1.19 Any foregoing composition, wherein the coloring agent is a combination of pigment and dye.

1.20 Any foregoing composition, wherein the coloring agent comprises 0.001 to 0.2% by weight of polymeric dye and 0.5 to 2% by weight of titanium dioxide.

1.21 Any foregoing composition further comprising clay. In certain embodiments, the clay is bentonite clay. The clay can also help retain fragrance in the composition.

1.22 The composition of 1.18, wherein the clay is present in an amount of 0.1 to 30% by weight of the composition.

1.23 Any foregoing composition further comprising an anti-caking agent, optionally, the anti-caking agent is silicon dioxide.

1.24 Any foregoing composition, wherein the anti-caking agent is present in the composition in an amount of front 0.1 to 1% by weight of the composition.

1.25 Any foregoing composition, wherein the composition is in the form of a powder, pellet, tablet, pastille or extrudate.

1.26 The composition of Composition 1, wherein the composition comprises:

35 to 37 weight % of a polyethylene glycol;

20 to 23 weight % of a polyalkylene polymer of formula: $H—(C_2H_4O)_x—(CH(CH_3)CH_2O)_y—(C_2H_4O)_z—OH$; wherein x is from 50 to 300; y is from 20 to 100, and z is from 10 to 200;

10 to 12 weight % of a polyethylene glycol fatty acid ester of formula: $(C_2H_4O)_q—C(O)O—(CH_2)_r—CH_3$; wherein q is from 20 to 200, and r is from 10 to 30;

3 to 5 weight % a polyethylene glycol fatty alcohol ether of formula: $HO—(C_2H_4O)_8—(CH_2)_t—CH_3$; wherein s is from 30 to 250, and t is from 10 to 30;

2 to 4 weight free fragrance;

3 to 5 weight % encapsulated fragrance; and 0.1 to 1 weight % glycerin.

1.27 The composition of 1.26 wherein the polyethylene glycol has a weight average molecular weight of 2,500 to 4,000.

1.28 The composition of 1.26, wherein the coloring agent comprises 0.001 to 0.2% by weight of polymeric dye and 0.5 to 2% by weight of titanium dioxide.

Also provided are methods for delivering an additive to clothes comprising washing the clothes in the presence of a composition of any of 1 to 1.28.

In some embodiments, the washing comprises the first stage or wash cycle of a clothes washing machine; and in some embodiments, the washing comprises the second stage or rinse cycle of a clothes washing machine. In further embodiments, the washing comprises manually washing the clothes.

In some embodiments, the compositions are a solid form, for example powder, pellet, tablet, pastille or extrudate, of any convenient shape. In some embodiments, the pastilles each have a mass of from 0.01 g-1 g, for example from 0.02-0.05 g, for example about 0.035 g, and also each have a longest size dimension of from 1-8 mm, for example from 4-6 mm each. The solid form releases fragrance upon dissolution, either in the wash cycle, or in a rinse cycle, or slowly over both cycles.

The polyol, such as glycerin, helps regulate the viscosity of the composition during processing while the composition is being formed into a pastille. The polyol can also help the optional clay swell into the polymeric mixture. The polyol also provides shine to the final composition once it is solidified.

The present invention further provides the use of the composition of any of 1 to 1.28 that includes fragrance as a laundry additive for washing clothes to impart a fragrance to the clothes.

The laundry scent additives include a coloring agent. The coloring agent can be a pigment, a dye, or a combination of pigment and dye. The coloring agent can be present in an amount of 0.001 to 5% by weight of the composition. Pigments can be any pigment. In one embodiment, the pigment is titanium dioxide. In certain embodiments, the pigment is present in the composition in an amount of 0.5% to 2% of the composition by weight. The compositions of the invention also preferably contain a dye, or multiple dyes, to impart color to the composition. In some embodiments, the dye is preferably a polymeric dye, present in the composition in an amount of, for example, from 0.001% to 0.2% by weight. While not wishing to be bound by a particular theory, it is believed that use of a polymeric dye helps to increase dye compatibility and retain color better over time, compared with the use of traditional dyes and pigments.

In some embodiments, the compositions of the invention include one or more additional inorganic ingredients, for example alumina and zirconium dioxide. Typically these additional ingredients are each present in the composition in an amount of from 0.001% to 0.05% by weight.

Example 1

A comparison between a formula with and without glycerin was made according to the following formulas, which are prepared by melting the oxyalkylene materials and adding and mixing the remaining materials:

| Material | Inventive Weight % | Comparative Weight % |
|---|---|---|
| Polyethylene Glycol | 30 | 32.9 |
| Bentonite Clay | 25 | 27 |
| Polyoxyalkylene ($H—(C_2H_4O)_x—(CH(CH_3)CH_2O)_y—(C_2H_4O)_z—OH$; wherein x is from 50 to 300; y is from 20 to 100, and z is from 10 to 200) | 19 | 18.5 |

-continued

| Material | Inventive Weight % | Comparative Weight % |
|---|---|---|
| Polyethylene Glycol Fatty Acid Esters | 9.6 | 9.3 |
| Free Fragrance | 5 | 5 |
| Glycerin | 4 | 0 |
| Polyethylene Glycol Fatty Alcohol Ethers | 3.2 | 3.1 |
| Encapsulated Fragrance | 3 | 3 |
| Titanium Dioxide | 0.94 | 0.94 |
| Silica | 0.2 | 0.2 |
| Alumina | 0.03 | 0.03 |
| Polymeric Dye | 0.03 | 0.03 |
| Total | 100 | 100 |

By visual observation, it was observed that the coloring agent (titanium dioxide and polymeric dye) were not as dispersed throughout the composition as compared to the composition having the glycerin. The composition without glycerin had a lighter shade of color.

What is claimed is:

1. A laundry additive composition, comprising:

a) polyethylene glycol, a polyoxyalkylene polymer, and at least one oxylated material chosen from a polyoxyalkylene fatty acid ester, and a polyoxyalkylene fatty alcohol ether;

b) a polyol;

c) a coloring agent; and d) at least one additive chosen from fragrance and a fabric treatment material.

2. The composition of claim 1, wherein the polyethylene glycol, the polyoxyalkylene polymer, and the at least one oxylated material are present in the composition in an amount of 30 to 90% by weight of the composition.

3. The composition of claim 1, wherein the polyalkylene polymer has a formula: $H—(C_2H_4O)_x—(CH(CH_3)CH_2O)_y—(C_2H_4O)_z—OH$; wherein x is from 50 to 300; y is from 20 to 100, and z is from 10 to 200;

wherein the polyethylene glycol fatty acid ester has a formula: $(C_2H_4O)_q—C(O)O—(CH_2)_r—CH_3$; wherein q is from 20 to 200, and r is from 10 to 30; and wherein the polyethylene glycol fatty alcohol ether has a formula: $HO—(C_2H_4O)_s—(CH_2)_t—CH_3$; wherein s is from 30 to 250, and t is from 10 to 30.

4. The composition of claim 3, wherein the polyethylene glycol is present in the composition in an amount of 30 to 90% by weight of the composition.

5. The composition of claim 3, wherein the polyalkylene polymer is present in the composition in an amount of 15 to 40% by weight of the composition.

6. The composition of claim 3, wherein the polyethylene glycol fatty acid ester is present in the composition in an amount of 1 to 10% by weight of the composition.

7. The composition of claim 3, wherein the polyethylene glycol fatty alcohol ether is present in the composition in an amount of 0.1 to 10% by weight of the composition.

8. The composition of claim 3, wherein the polyethylene glycol has a weight average molecular weight of 2,000 to 10,000.

9. The composition of claim 1, wherein the polyol is selected from the group consisting of glycerin and sorbitol.

10. The composition of claim 1, wherein the polyol is present in an amount of 0.1 to 10% by weight of the composition.

11. The composition of claim 1, wherein the additive is fragrance and is present in an amount of from 0.1 to 10% by weight of the composition.

12. The composition of claim 1, wherein the additive is the fabric treatment material and is selected from the group consisting of a fabric conditioning agent, anti-static agent, an alkyl trimethyl ammonium compound, an amidopropyl trimethyl ammonium compound, a fatty acid amide, tetraethylenepentamine, amino functional silane, and cetyl trimethylammonium chloride and combinations thereof.

13. The composition of claim 1, wherein the coloring agent is a combination of dye and pigment and is present in an amount of 0.01 to 5% by weight of the composition.

14. The composition of claim 1, further comprising clay, and wherein the clay is present in an amount of 0.1 to 50% by weight of the composition.

15. The composition of claim 1, further comprising an anti-caking agent, wherein the anti-caking agent is present in the composition in an amount of from 0.1 to 1% by weight of the composition.

16. The composition of claim 1, wherein the composition is in the form of a powder, pellet, tablet, pastille or extrudate.

17. The composition of claim 1, wherein the composition comprises:

a) 35 to 37 weight % of a polyethylene glycol;

b) 20 to 23 weight % of a polyalkylene polymer of formula: $H—(C_2H_4O)_x—(CH(CH_3)CH_2O)_y—(C_2H_4O)_z—OH$; wherein x is from 50 to 300; y is from 20 to 100, and z is from 10 to 20;

c) 10 to 12 weight % of a polyethylene glycol fatty acid ester of formula: $(C_2H_4O)_q—C(O)O—(CH_2)_r—CH_3$; wherein q is from 20 to 200, and r is from 10 to 30;

d) 3 to 5 weight % a polyethylene glycol fatty alcohol ether of formula: $HO—(C_2H_4O)_s—(CH_2)_t—CH_3$; wherein s is from 30 to 250, and t is from 10 to 30;

e) 2 to 4 weight % free fragrance;

f) 3 to 5 weight % encapsulated fragrance; and g) 0.1 to 1 weight % glycerin.

18. The composition of claim 17, wherein the polyethylene glycol has a weight average molecular weight of 2,500 to 4,000, and wherein the coloring agent comprises from about 0.001 to about 0.2% by weight of polymeric dye and from about 0.5 to about 2% by weight of titanium dioxide.

19. A method for imparting fragrance, softness or anti-static properties to clothes, comprising washing the clothes in the presence of a composition according to claim 1.

* * * * *